United States Patent [19]

Fickers

[11] 4,250,822

[45] Feb. 17, 1981

[54] LOW BULK, PIN-TYPE SEAM FOR USE IN PAPER MAKING EQUIPMENT FABRICS, SUCH AS DRYER FELTS

[75] Inventor: Gisela Fickers, Eupen, Belgium

[73] Assignee: Asten Group, Inc., Devon, Pa.

[21] Appl. No.: 100,946

[22] Filed: Dec. 6, 1979

[51] Int. Cl.[3] ..... D05B 97/08

[52] U.S. Cl. ..... 112/262.1; 112/406; 112/409; 112/441; 2/275

[58] Field of Search ..... 112/262.1, 265.1, 441, 112/440, 400, 401, 406, 409; 2/275

[56] References Cited

U.S. PATENT DOCUMENTS

| | | | |
|---|---|---|---|
| 227,947 | 5/1880 | Beane | 112/441 |
| 803,882 | 11/1905 | Coon | 112/441 |
| 3,281,905 | 11/1966 | Wagner | 112/400 X |

*Primary Examiner*—H. Hampton Hunter

*Attorney, Agent, or Firm*—Benasutti Associates, Ltd.

[57] ABSTRACT

A novel low bulk seam is disclosed for use in paper making machine fabrics, such as dryer felts. The seam is particularly adapted for use with multi-filament yarns which comprise multi-ply fabrics. A novel method for producing this seam is disclosed which comprises the insertion of a seaming coil, the removal of picks in adjacent fabric areas, the folding and sewing of such areas, the creation of a warp fringe, the weaving back of portions of that fringe into the fabric body, and the application of various fasteners including adhesive and sewing to create a unique, reliable seam providing substantially uniform thickness and air permeability across the full fabric width. A durable, reliable, non-marking seam is accordingly provided.

27 Claims, 8 Drawing Figures

LOW BULK, PIN-TYPE SEAM FOR USE IN PAPER MAKING EQUIPMENT FABRICS, SUCH AS DRYER FELTS

BACKGROUND OF THE INVENTION

The present invention relates to the field of paper machine clothing, and more particularly to clothing for use in the dryer sections of such machines. The dryer section of a paper making machine is that portion of the machine wherein a wet paper web is dried down to about 6% water on large cast iron, steam-heated cylinders. These large smooth cylinders dry the web into a flat sheet. A dryer felt/fabric is needed to hold the wet web in intimate contact with the smooth dryers, otherwise wrinkles and cockles may develop in the sheet. If the sheet is not flat, serious difficulties may develop in the printing process. As paper machines have developed, dryer felts approaching 400 inches in width have come into use. Venting pockets in the dryers intended to purge excessive hot, moist air have also been developed which require new, extremely permeable dryer felt designs. Additionally, over the years the speed of operation of such dryer felts has increased, and is now approaching the four to five thousand feet per minute range. Since dryer felts are formed in the shape of long belts which are threaded around various guides, cylinders and rollers, in almost all paper making machines it is necessary to provide a seam in the felt at which the two ends, known as lap and hook ends, may be joined after the felt has been threaded through the appropriate paper making machine parts. Due to the high speed, pressures, moisture, heat and other conditions of operation to which these dryer felts are subjected, the seam and the fabric in the immediate vicinity of the seam are subjected to extreme conditions of wear. Additionally, substantial increased thickness and overlapped fabric ends can result in marking and/or other irregularities in the paper product to be dried.

In recent years, monofilament dryer fabrics have been developed which utilize "pin" seams wherein alternate monofilament warp ends are caused to form a "loop" at the end of the fabric and are woven back into the body of the fabric (with corresponding removal of appropriate warp ends). The loops thus formed at the end of a monofilament fabric mate with complemental loops formed in the other end of that fabric so that a long wire or "pin" (pintel) may be inserted through the channel formed therebetween to join the two fabric ends. A seam thus formed in a monofilament fabric is not substantially thicker than the normal fabric thickness.

In recent years, various coil-type seams have also been developed wherein coils or spirals are inserted along a fold line and the fabric folded back over itself and sewn or otherwise attached to itself so that the coil may mateably receive a coil similarly attached to the other end of the dryer felt/fabric. A pin or wire may then be used to join the seam. To date, attempts to create a true "pin" type seam in multi-filament fabrics have been unsuccessful due to a lack of stability of the geometric configuration of loops formed from multi-filament (and even some monofilament) warp yarns of such fabric. While coil seams have achieved some success in the field of paper machine clothing, the additional thickness and thickness irregularity attendant with such seams has limited their applicability, life and/or reliability.

Various materials have been suggested for use in making coil-type seams. For example, spirals of polyester monofilament have been suggested which are manufactured by taking extruded polyester monofilament yarn, wrapping it around a mandrel, and heat setting it to cause it to take a spiral shape. It is also known to create spirals of multi-filament material, particularly materials which is capable of being heat set in a similar manner. For example, it is known to create a spiral or coil for insertion into a coil-type seam by taking a nylon monofilament and using a conventional braiding machine to braid around that monofilament with polyester and aramide threads, whereupon the resulting material may be wound on a mandrel and heat set. As used hereinafter in this application, the term "coil material" shall refer to any of the spirals or coils heretofore known to the art, but preferably to the braided multi-filament coil described above.

SUMMARY OF THE INVENTION

The present invention provides a novel method for producing a "pin-type" coil seam in fabric to be used for clothing paper making equipment. This seam is produced by performing various sequential steps of removing pick yarns from the fabric in the vicinity of a seam fold line. Pick yarns are first removed to facilitate the insertion of a spiral coil, after which preselected numbers of pick yarns on either side of the coil are removed so that upon a subsequent fold over operation, a reduced fabric bulk in the vicinity of the fabric end (seam half) is created. Additional pick yarns are removed from the overlapping fabric end to create a warp yarn fringe which is then pulled back through the interior of a portion of the fabric body so that the slight additional bulk which is created in the fabric in the vicinity of the seam undergoes a relatively smooth transition with respect to the normal thickness of the fabric body.

The novel low bulk seam of the present invention is particularly adapted for use with fabrics made with multi-filament yarns, and more particularly, multi-filament warp yarns. In accordance with the preferred method of the present invention, a seaming coil is firmly and uniformly anchored with respect to the fabric end by threading a portion of the seaming coil back into itself to overlap a bolt thread, by using an adhesive application, and by subsequent resin treating. In this manner the desired geometric configuration of the coil is stabilized so that the fabric ends may easily be joined during installation of the paper clothing.

In accordance with the preferred method of the present invention, stitching is utilized in the production of the preferred seam, which stitching is carefully located in positions which substantially improve the quality and dimensional stability of the seam without imparting undesirable wear and/or marking characteristics to the seam.

Accordingly, a primary object of the present invention is the provision of a novel coil-type low bulk seam for use particularly with multi-ply, multi-filament paper machine clothing fabrics.

This, and other objects of the present invention will become apparent from the following more detailed description.

DETAILED DESCRIPTION OF THE PREFERRED EMBODIMENT

Figure 1:
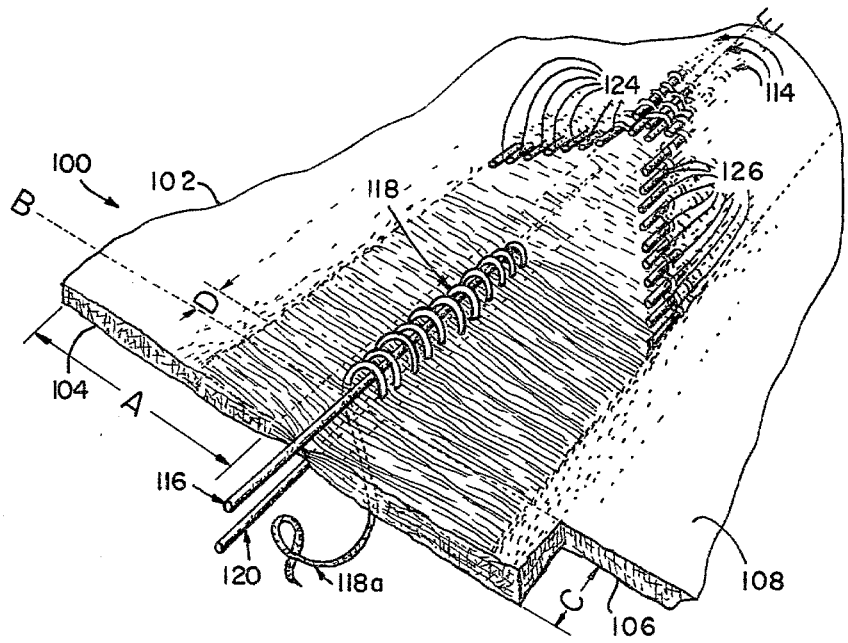
FIG. 1 is a diagrammatic, perspective, fragmentary view of a portion of an end of a two-ply fabric illustrating the steps of removing pick yarns to create apertures for a seaming coil, insertion of that seaming coil, and removal of additional pick yarns from the back ply of said fabric in regions adjacent to said coil. The figure further illustrates a portion of the width of that fabric being trimmed to size.

Although specific forms of the invention have been selected for illustration in the drawings, and the following description is drawn in specific terms for the purpose of describing these forms of the invention, this description is not intended to limit the scope of the invention which is defined in the appended claims.

The novel seam of the present invention is constructed from multi-ply fabrics, particular multi-ply fabrics containing multi-filament warp yarns, as described more fully hereinafter. As used in this application, the term "multi-filament yarns" is intended to include spun yarns. In the paper machine clothing industry, dryer felts are often produced having two or three plys, that is, two to three distinct layers of pick or filler yarns. It is within the scope of the present invention, however, to utilize the disclosed methods with fabrics having more than three-plys, if desired. Additionally, while the present invention is described in connection with multiple ply fabrics comprising multi-filament yarns, it is anticipated that either the warp or pick yarns or both of the fabric may be mono-filament yarns and spun or staple yarns, if desired.

Referring now to the drawings, and particularly to FIGS. 1–4, a fragmentary portion of the corner of a two-ply fabric is disclosed to illustrate various stages of seam formation. In FIG. 1, the fabric end designated generally 100 is seen to comprise a terminal edge 102, a side edge 104 and a trimmed edge 106. The back surface 108 of the fabric designated generally 100, faces upwardly, that is, towards the viewer. In accordance with the preferred embodiment method of the present invention, a length of fabric to be seamed is provided comprising a plurality of longitudinal warp yarns interwoven with a plurality of ply forming layers of transverse pick yarns, said layers defining at least front and back plys. The location of such plys is particularly well illustrated in FIGS. 3 and 4 of these drawings, wherein it will be noted that the ends 110 of the transverse pick yarns of the face layer and 112 of the back layer are readily visible.

The fabric to be seamed is selected to be of a preselected length "A" longer than the desired fabric length upon completion of the seam half. Typically, "A" ranges between 5 and 9 inches, preferably 6 to 8 inches. Additionally, the fabric, designated generally 100, should be selected to be somewhat wider than the finished width, so that a final seam and fabric edge as represented by dotted line "B" may be established by trimming off a width such as width "C," of the fabric. This seam offset distance "C" is preferably between ½ inch and 3 inches, and more preferably is between 1 to 2 inches. Finally, a seam edge margin "D" as illustrated in FIG. 1, is maintained which represents the margin between the end of the seaming coil and the trimmed edge "B" of the fabric.

The next step in the construction of the seam half involves removing, at a preselected fabric position, a preselected number of pick yarns to create apertures therein which define a fold line which corresponds to the fabric terminus of one of the sides of the seam to be formed. This fold line axis is illustrated in FIG. 1 by broken line "E." The apertures thus formed by the removal of a preselected number of pick yarns will be disposed to receive the insertion of a seaming coil, said fold line defining adjacent fabric body and fabric overlap regions on said fabric. In the preferred embodiment for a two-ply construction, 3 face and 3 back picks are removed from the fabric, which picks are seen to be cut furthest back in FIG. 1, and which have been designated generally 114.

In selecting the fabric position at which a preselected number of said pick yarns are to be removed, it is preferable with a two-ply fabric that the 1–3 warp yarn falls on the ninth pick in the fabric overlap region of said fabric. If the 1–3 warp yarn does not fall on the ninth pick, the coil insertion area, that is, the fold line "E," should be moved to one side or the other in order to insure the proper seam installation. With most fabrics this adjustment should only be one pick forward or backward for correct placement.

The next step in the seam producing method is the insertion of a seam coil, designated generally 118, by threading said coil through said apertures, and by retaining said coil by simultaneously threading a bolt thread designated generally 116 between the coil and the back surface of the fabric. In the preferred embodiment, the coils are of the braided type described above. For ease of final seam installation, blue colored coils may be installed on the lap (leading) end, and orange colored coils may be installed on the hook (trailing) end of the seam. In order to insure that the leading and trailing ends of the seam will mateably engage each other, it may be desired before installing coils to place both ends of the fabric together with the fold over sections back, at which point marks may be made to mark the first and last hooks of the comb or coil to be formed in the fabric across the width of the fabric. This procedure will insure that the proper number of coils will be installed within the same distance on each end of the fabric.

In addition to the bolt thread, designated generally 116, it is preferred to additionally install a rigid wire designated generally 120 which is threaded through the coils on the face side of the seam. Between the bolt thread 116 and rigid wire 120, no coils will be lost during the removal of a conventional coil installer which may be utilized to accomplish this step. In the preferred embodiment, 0.072 inch OD forming wire may be utilized or (less preferably) 0.054 inch OD music wire may be used as wire 120.

The next step in producing the desired seam comprises the step of removing preselected pick yarns from the back ply of the fabric in the fabric body and fabric overlap regions adjacent said coil. While the precise number of back picks to be removed may be varied somewhat, it is preferable at this step to remove slightly (i.e., 1–3) more back picks from the body fabric region than from the overlap region of the fabric. For the two-ply seam shown in FIG. 1, seven picks 124 are shown cut away in the overlap region of the fabric, whereas ten picks 126 are illustrated cut away in FIG. 1. It is to be understood that while picks 114, 124 and 126 are illustrated only as being partially removed, in the performance of the method of the present invention, at appropriate process steps, the entirety of these picks across the width of the fabric will be removed, just as the insertion of the coil 118 will continue across the full width of the fabric rather than terminating in the position part way across the fabric as shown in FIG. 1. The method used for removing these picks may be any of those methods commonly utilized in the art for removing individual yarns from a woven fabric, and may comprise the utilization of a pick out needle or scribing tool for this purpose.

Figure 2:
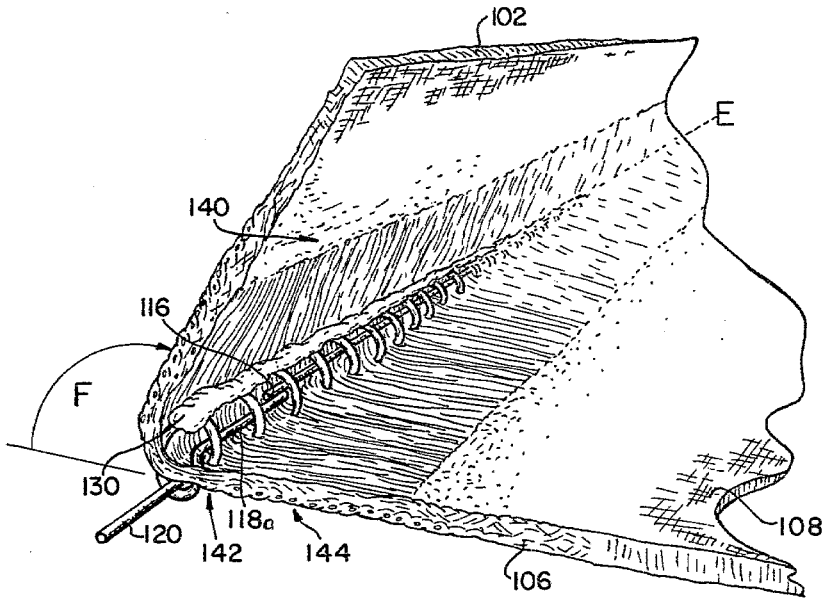
FIG. 2 is a perspective, diagrammatic, fragmentary view of the fabric end illustrated in FIG. 1, illustrating the fold over step which is performed following the application of adhesive, as shown in FIG. 2.

Referring now in particular to FIG. 2, the end 118*a* of the coil will be finished by making sure that the coils do not extend any closer to the finished fabric edge "B" than the preselected edge margin "D", which in the preferred embodiment is at least ⅛ of an inch, no more than ⅜ of an inch, and preferably about ¼ of an inch. The excess amount or end 118*a* of the coil is then tucked back through itself to substitute near the end of the coil for the bolt thread, and is caused to overlap the bolt thread by a short distance. In the preferred embodiment, the excess amount of coil material tucked back into the seam edge is between 1 to 2 inches, preferably 1½ inches, and the coil material is caused to overlap the bolt thread by about ¼ inch. If desired, at this point, the lap end and hook end of the seam may be temporarily matched to determine whether any problems or errors in the seam forming operation can be detected. If the leading and trailing ends match, a bead of glue 130 may now be applied over the bolt thread for the length of the seam. In the preferred embodiment, the glue or adhesive to be used may be Minnesota Mining and Manufacturing Company, Scotch Adhesive No. 1099. After waiting a sufficient amount of time to permit set up (about 5 minutes) the fabric overlap region on the fabric may be folded along the fold line "E" through the arc "F" indicated in FIG. 2, making sure to align the warps and picks correctly during the fold over process. The overlap region of the fabric may be properly aligned and retained with respect to the fabric body by using hand applied staples every several inches, preferably located between the third and fourth picks (to avoid later sewing problems).

The next step in the seam forming process is stitching the fabric body and overlap regions adjacent the coil together, this stitching being disposed along at least a substantially transverse line 42 intermediate ones of said pick yarns. As seen particularly in FIG. 2, it will be noted that a considerable portion of the overlap region designated generally 140 and extending to edge 102 has not had its pick yarns removed. This seam line may be sewn using extremely light or no tension on the sewing thread, while still maintaining the proper sewing stitch configuration. The thread may be, for example, a row of "Nomex" aramide sewing thread between the first and second picks. Additionally, a second row of sewing, as for example, between the sixth and seventh picks, such as row 144 may also be applied, all of these sewings being installed carefully to minimize the deflecting out of the pick line, especially at the seam edges.

Figure 3:
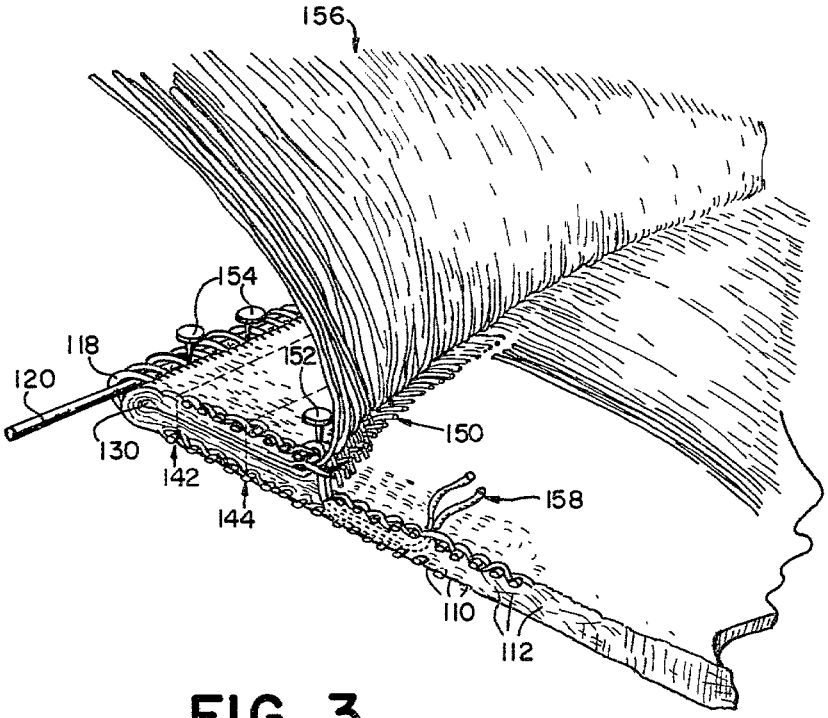
FIG. 3 is a diagrammatic, perspective, fragmentary view of the fabric end illustrated in FIGS. 1 and 2, illustrating the steps of temporary tacking of the work piece to a work surface, cut off of certain warp yarns, the creation of a warp fringe, and the weave-back of several warp fringe yarns.
Figure 4:
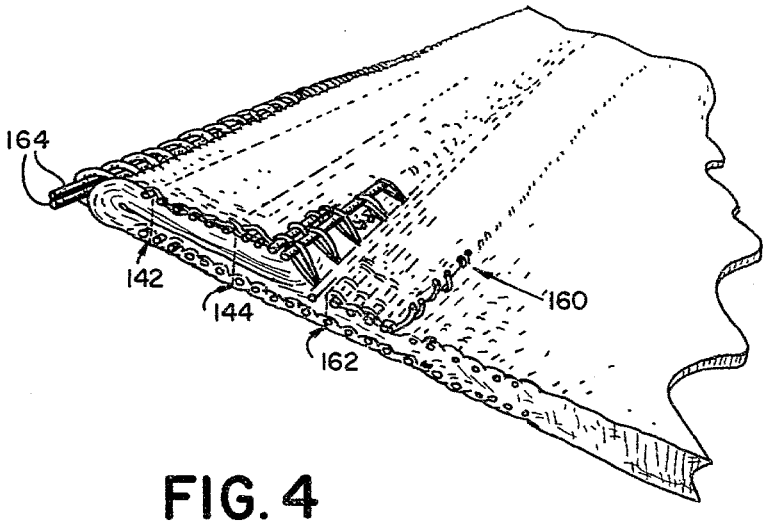
FIG. 4 is a perspective, diagrammatic, fragmentary view of the finished fabric end illustrated in FIGS. 1–3, which fabric end mates with a complementally constructed fabric end to receive a "pin" or seaming wire, such as the wires shown in FIG. 4, to comprise the seam of the present invention.
Figure 5:
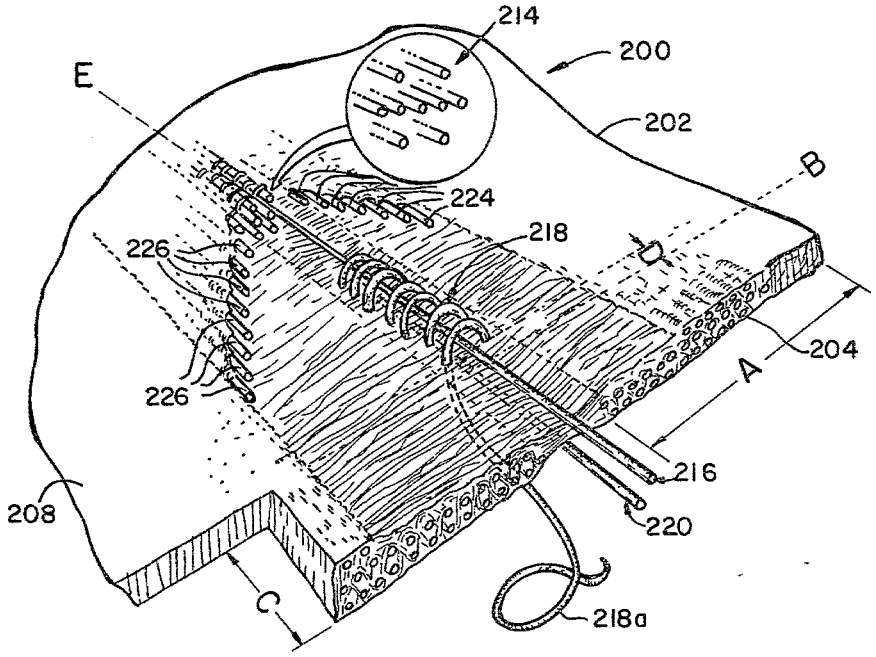
FIG. 5 is a diagrammatic, perspective, fragmentary view of a fabric end of three-ply fabric illustrating similar steps as those illustrated for the two-ply fabric end illustrated in FIG. 1, a blown up portion of the three-ply fabric being provided for purposes of clarity.
Figure 6:
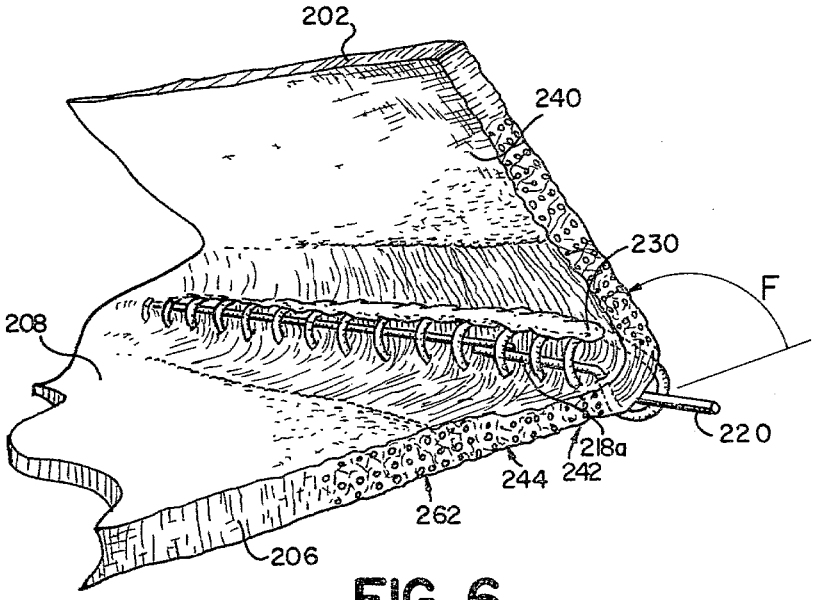
FIG. 6 is a diagrammatic, perspective, fragmentary view of the three-ply fabric end illustrated in FIG. 5, illustrating similar steps as those illustrated for a two-ply fabric in FIG. 2.

At this point in the process, the plain weave warp yarns 150 may be cut in the manner illustrated in FIG. 3, said cutting being shown in progress in FIG. 3. These warp yarns may be cut using a seam ripper tool such as that available at a local sewing machine or fabric store.

At this point, the fabric face may be fastened down to the front edge of a working table using tacks such as tacks 152 installed between the tenth and eleventh picks at periodic locations of 5 or 6 inches across the entire width of the fabric. It is also desirable to install tacks in the coil area, such as tacks 154 at longitudinal positions corresponding to tacks 152. It is convenient to position the fabric so that the fifteenth pick of the fabric is lined up with the front edge of the work table. It is now convenient to ravel out the filling yarns in the overlap region of the fabric creating fringe designated generally 156.

The next step of the process is the step of drawing at least portions of the warp yarn fringe between yarns in said fabric body region to complete the first half of said coil seam. This is accomplished by using a crochet needle or other similar tool which is pushed between the layers of fabric, preferably under the eleventh, twelfth, thirteenth, fourteenth, and fifteenth picks, grabbing the adjacent face, plain weave and 1–3 warp yarns and pulling them simultaneously through and out of the fabric between the fifteenth and sixteenth picks. This process is shown beginning in FIG. 3. The back 1–3 warp yarns 158 are shown protruding from the back of the fabric between the tenth and eleventh picks. The procedure is to be repeated across the entire width of the seam, after which all loose warp yarns such as warp yarns 158 protruding from the back of the fabric should be cut off as close as possible to the back surface of the fabric as shown particularly along the cut off line 160 shown in FIG. 4. This weave back line 160 accordingly comprises trimmed 1–3 and 1—1 warp yarns.

It is preferred at this point to return the fabric to a sewing machine to install a third sewing 162, preferably between the eleventh and twelfth picks. At this point, a rectangular configuration enforcement sewing may also be performed which may include the first and third rows of sewing with a $\frac{3}{4}$ inch wide space between the vertical sewings, starting $\frac{3}{8}$ inch from the ordered width edge of the fabric.

Whether performed simultaneously or performed sequentially, each of the above steps which have been described with respect either to the lap or hook ends of the fabric should be repeated with respect to the complemental end of the fabric not yet processed in order to form mating seam halves. In this manner, the lap and hook ends of the seam may be mateably interposed to define a pin receiving channel suitable for the reception of a seam-joining pin or wire.

Having completed the mechanical construction of the seam, the seam and fabric are now ready for finishing, which is preferably accomplished using a resin treatment. The fabric may be installed on a stitching machine and joined with two suitably sized synthetic pintels. It is preferred that the fabric to be used will have been heat set prior to the beginning of the seam construction method. At this point, if puckers appear in the seam area on applying fabric treatment tension, these can be removed with the application of a local heat through the use of a hot air blower. If no puckers appear, edge cutting and sealing procedures of a conventional type may be performed and the fabric resin treated. It is preferred that a light application of epoxy resin be applied only to the back surfaces of the sewings in the seam area. It is not desirable to treat the vertical reinforcement sewing with resin. A $\frac{1}{4}$ inch wide bead of epoxy resin should preferably be applied at the edges and ends of the seam down the seam edge for $\frac{1}{2}$ inch on the face and back of the seam. A $\frac{1}{4}$ inch wide bead of epoxy resin between the coils and first row of sewings may also be applied, skipping $\frac{3}{4}$ of an inch and then applying more epoxy resin for 1 inch between the coils and first row of sewing. Preferably, polyurethane resin may then be applied to the coil loops, which step can be completed while the epoxy resin is drying and curing. In order to complete the finished seam, two suitably sized joining wire assemblies 164 are preferred for final assembly of the seam.

In accordance with the preferred method of the present invention, three-ply fabrics may also be utilized in producing the low bulk seam of the present invention. The method of producing such a seam is illustrated in FIGS. 5–8, which figures generally correspond to FIGS. 1–4 described above with respect to a two-ply fabric. These figures have had their components numbered in the "200 series," each component so numbered being 100 greater than the corresponding component identified in FIGS. 1–4 with respect to two-ply fabrics. Except as discussed hereinbelow, the preferred method of producing a seam in three-ply fabric is identical to the method used in producing such a seam in two-ply fabric, as described above.

Figure 7:
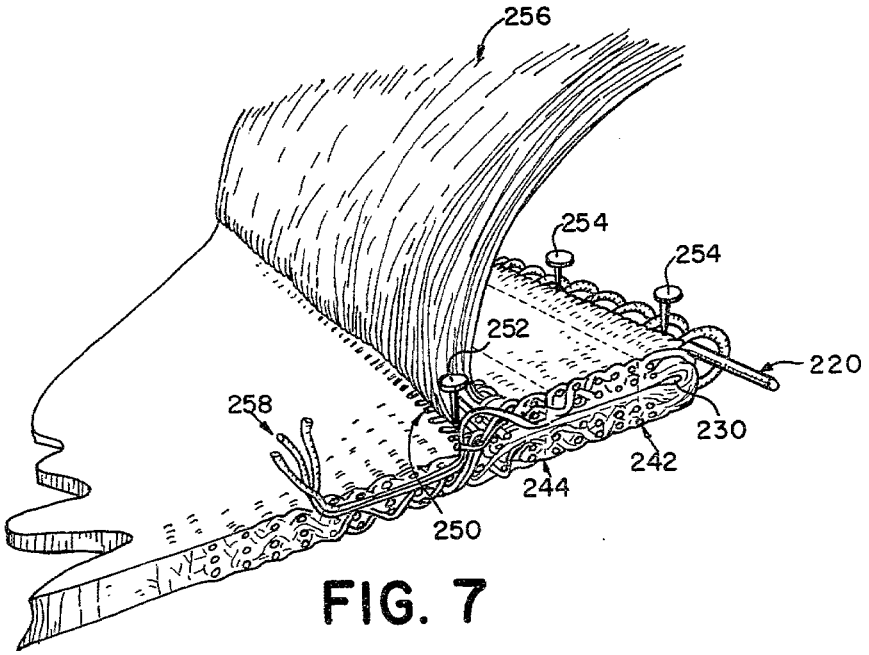
FIG. 7 is a diagrammatic, perspective, fragmentary view of the three-ply fabric end illustrated in FIG. 6 illustrating similar process steps as those illustrated for two-ply fabrics illustrated in FIG. 3, relatively more warp yarns having been cut off in the illustration in FIG. 7 than those illustrated in FIG. 3.

Unlike the method described with respect to the two-ply fabric, it is not important in locating a fold line to identify the warp yarn configuration over the ninth pick. In order to create appropriate apertures, however, for installing coils, it may be necessary to remove three stuffer picks. Accordingly, referring to FIG. 5, the removal of two face and two back picks is illustrated showing their relative orientation to five intermediate stuffer picks. The central three of these stuffer picks are to be removed, as illustrated in the enlarged view within the circle of FIG. 5 which is designated generally 214. For other fabrics, it is only necessary to remove two face, middle and back picks across the fabric width in order to create the apertures for installation of the coil materials. Unlike the two-ply construction described above, it is preferred to remove nine back picks starting from the coil area and seven back picks on the overlapping region, which are designated 226 and 224 respectively in FIG. 5. The process may then proceed as described with respect to a two-ply fabric, except after the initial two rows of stitching have been completed, the back warp yarns over the eighth and ninth picks of the overlapping region of the fabric should be cut, and using a crochet needle in the manner described above, two adjacent warp yarns in the warp yarn fringe which has been created by removing the tenth and greater picks on the overlap portion of the fabric should now be drawn under the tenth, eleventh, twelfth, thirteenth, and fourteenth back picks of the body region of the fabric. The final line of sewing 262 may then be installed between the eleventh and twelfth pick. It should be noted that with various weaves, such as a skip dent warp arrangement, the precise configuration of the pull through may be altered, resulting in the pulling through of two adjacent ends at a time instead of three adjacent ends 258 as illustrated in FIG. 7 for three-ply fabric.

Figure 8:
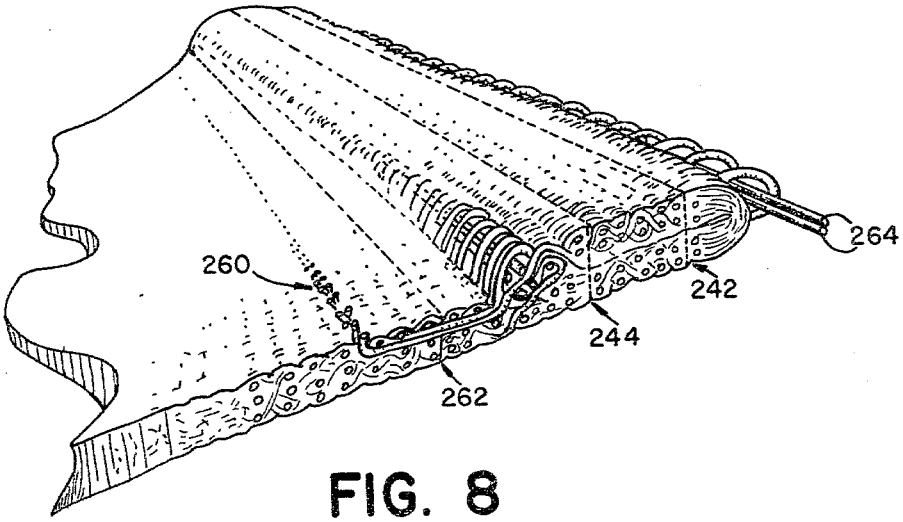
FIG. 8 is a diagrammatic, perspective, fragmentary view of the three-ply fabric end illustrated in FIGS. 5–7, which is complete and represents one half of a complete three-ply fabric seam.

Once the remaining process steps have been completed to produce the finished seam end illustrated in FIG. 8, the seam may be treated and subjected to finishing and resin operations in the same manner as described above with respect to two-ply fabrics and seams created therefrom.

From the above it will be seen that a unique, durable, low bulk coil-type pin seam is disclosed which combines many of the advantages of sewing overlapping portions of fabric in a coil-type construction, while additionally incorporating reduced bulk in the seam area and a woven-in end to create a smooth transition from the slight additional bulk in the seam area towards the normal thickness of the fabric body.

It will be understood that various changes in the details, materials and arrangement of parts which have been herein described and illustrated in order to explain the nature of this invention may be made by those skilled in the art within the principle and scope of the invention are expressed in the following claims.

It will further be understood that the "Abstract of the Disclosure" set forth above is intended to provide a non-legal technical statement of the contents of the disclosure in compliance with the Rules of Practice of the U.S. Patent and Trademark Office, and is not intended to limit the scope of the invention described and claimed herein.

What is claimed is:

1. A method of producing a low bulk, pin-type seam in a multi-ply fabric for use with paper making equipment, comprising the steps of:

(a) providing a length of fabric to be seamed comprising a plurality of longitudinal warp yarns interwoven with a plurality of ply-forming layers of transverse pick yarns, said layers defining at least front and back plys, said length of fabric being of a preselected length which is longer than the desired seamed fabric length;

(b) removing at a preselected fabric position, a preselected number of said pick yarns to create apertures therein which define a fold line which corresponds to the fabric end of one of the sides of the seam to be formed, said apertures being disposed to receive the insertion of a seaming coil, said fold line defining adjacent fabric body and fabric overlap regions on said fabric;

(c) installing a seaming coil by inserting said coil through said apertures;

(d) removing preselected pick yarns from said back ply of said fabric in said fabric body and fabric overlap regions adjacent said coil;

(e) folding at least a portion of said overlap region at said fold line to overlap said fabric body region to form a seaming edge defined by said coil;

(f) stitching said regions together at least in a seam overlap area adjacent said coil, said stitching being disposed along at least a substantially transverse line intermediate ones of said pick yarns;

(g) creating a warp yarn fringe on a portion of said fabric overlap region which is remote to said seam overlap area, by at least removing picks from said fabric overlap region;

(h) drawing at least portions of said warp yarn fringe between yarns in said fabric body region to complete a first half of said coil seam; and (i) performing at least steps (b) through (h) with respect to a different fabric position whereby a second half of said coil seam is formed to matingly receive said first half to define a pin receiving channel suitable for reception of a seam-joining pin.

2. The invention of claim 1 wherein step (b) comprises the step of removing a plurality of said pick yarns to create said apertures.

3. The invention of claim 2 wherein step (b) further comprises the step of removing a preselected number of said pick yarns from each layer of said fabric to create said apertures.

4. The invention of claim 3 wherein 2–3 pick yarns are removed from each of said layers.

5. The invention of claim 1 comprising the additional step of threading a bolt thread between portions of said seaming coil and the back surface of said fabric.

6. The invention of claim 1 wherein a retaining wire is temporarily threaded between portions of said seaming coil and a front surface of said fabric for retaining said seaming coil position during at least one of steps (d), (e), (f), (g) and (h).

7. The invention of claim 1 wherein step (d) further comprises removing between 5 and 12 preselected pick yarns in each of said fabric body and fabric overlap regions.

8. The invention of claim 7 wherein step (d) comprises the step of removing between 7 and 9 of said pick yarns to be removed are those which are most adjacent to said seaming coil within said back ply of said fabric in said fabric body and fabric overlap regions.

9. The invention of claim 8 wherein step (d) further comprises the removal of 9 back picks starting from the coil installed area and the removal of 7 back picks in the fabric overlap regions starting from the coil installed area.

10. The invention of claim 1 wherein step (c) further comprises the step of threading at least a portion of said seaming coil ends back between the back surface of said fabric and within other portions of said seaming coil.

11. The invention of claim 10 comprising the additional step of threading a bolt thread between said back surface of said fabric and portions of the loops of said seaming coil, portions of said bolt thread overlapping at least portions of said seaming coil.

12. The invention of claim 1 comprising the additional step of applying a bead of glue along the back of said seaming coil prior to performing step (e) to bond and position said seaming coil with respect to said fabric at least upon performing step (e).

13. The invention of claim 12 further comprising the step of stapling said overlapping regions to each other following the performance of step (e).

14. The invention of claim 13 wherin said staples are applied between the third and fourth picks away from said fold line.

15. The invention of claim 1 wherein said step of stitching said regions together comprises the step of stitching between the first and second picks away from said fold line.

16. The invention of claim 1 wherein step (f) further comprises the step of stitching a row of sewings between the sixth and seventh picks.

17. The invention of claim 1 wherein step (f) further comprises stitching rows of sewings between the first and second and between the sixth and seventh picks, said sewings being installed at about $6\frac{1}{2}$ stitches per inch.

18. The invention of claim 1 wherein step (g) further comprises the step of cutting a preselected number of back warp yarns along a preselected transverse axis.

19. The invention of claim 1 wherein step (g) further comprises the step of tacking the fabric end face down to a work surface prior to creating said warp yarn fringe.

20. The invention of claim 18 wherein said step of creating said warp yarn fringe comprises the steps of removing pick yarns in the vicinity where said fringe is to be formed, and unraveling said warp yarns to create said fringe.

21. The invention of claim 18 wherein said warp yarn fringe is created after the ninth pick away from said fold line.

22. The invention of claim 1 wherein at least a plurality of the yarns of said warp yarn fringe are drawn along the same path between yarns in said fabric body region.

23. The invention of claim 21 wherein step (h) comprises the drawing of at least 3 warp yarn fringe warp yarns along the same path within said fabric body region.

24. The invention of claim 22 wherein said step (h) comprises the step of drawing portions of said warp yarn fringe within yarns in said fabric body region which are adjacent to at least picks 10, 11 and 12 of said fabric body region.

25. The invention of claim 1 further comprising the additional step following step (h) wherein an additional row of sewings are stitched along a transverse axis to engage at least a portion of said warp yarn fringe which is located between yarns in said fabric body region.

26. The invention of claim 1 comprising the additional step of resin treating at least a portion of said seam to improve at least the dimension stability of said seaming coils.

27. The product produced in accordance with the method of claim 1.

* * * * *

UNITED STATES PATENT OFFICE

CERTIFICATE OF CORRECTION

Patent No. 4,250,822 Dated February 17, 1981

Inventor(s) Gisela Fickers

It is certified that error appears in the above-identified patent and that said Letters Patent are hereby corrected as shown below:

After column 10 line 64 add the following claims:
--28. A method for producing a low bulk, pin-type seam in a multi-ply fabric having multi filament warp and pick yarns for use with paper making equipment, said method comprising the steps of:

(a) providing a length of said multi-ply fabric having a pre-selected length which is in excess of the desired seamed fabric length, said multi-ply fabric further having front and back plies;

(b) removing pick yarns to create appertures in the said fabric and define a fold line, said fold line defining adjacent fabric body and fabric overlap regions on said fabric;

(c) installing a seaming coil through said appertures created by removing said pick yarns in step (b);

(d) removing additional pick yarns in said fabric body and fabric overlap regions adjacent to said coil, said pick yarns being removed from said back ply of said multi-ply fabric;

(e) folding said fabric along said fold line to position said overlap region over said body fabric region to form a seaming edge defined by said coil;

(f) stitching said overlap region and said body fabric region together along a line adjacent

CERTIFICATE OF CORRECTION

Patent No. 4,250,822 Dated February 17, 1981

Inventor(s) Gisela Fickers

It is certified that error appears in the above-identified patent and that said Letters Patent are hereby corrected as shown below:

to said coil and substantially perpendicular to said warp yarns;

(g) creating a warp yarn fringe on a portion of said fabric overlap region which is remote from said coil;

(h) drawing at least a portion of said warp yarn fringe between yarns in said fabric body region to complete a first half of said seam; and (i) performing at least steps (b) through (h) at a predetermined second position along said length to form a second half of said seam, said second half matable with said first half to define a pin receiving channel.

29. The method of Claim 28 further comprising the step of inserting a bolt thread between portions of said seaming coil and the back surface of said fabric.

30. The method of Claim 28 wherein a retaining thread is temporarily positioned between portions of said seaming coil and the front surface of said fabric.

31. The method of Claim 28 wherein step (d) further comprises removing between 5 and 12 preselected pick yarns in each of said fabric body and said fabric overlap regions.

UNITED STATES PATENT OFFICE

CERTIFICATE OF CORRECTION

Patent No. 4,250,822 Dated February 17, 1981

Inventor(s) Gisela Fickers

It is certified that error appears in the above-identified patent and that said Letters Patent are hereby corrected as shown below:

32. The method of Claim 31 wherein step (d) further comprises the removal of 9 back pick yarns from said body fabric region and the removal of 7 back pick yarns from the fabric overlap region, said yarns being removed from a position adjacent to said fold line.

33. The method of Claim 28 wherein step (c) further comprises the step of threading at least a portion of said seaming coil ends back between the back surface of said fabric and within said seaming coil.

34. The method of Claim 28 further comprising the additional step of applying a bead of adhesive along the back of said seaming coil prior to performing step (e).--

On The Title Page "27 Claims" should read -- 34 Claims --.

Signed and Sealed this

Twelfth Day of May 1981

[SEAL]

Attest:

RENE D. TEGTMEYER

Attesting Officer

Acting Commissioner of Patents and Trademarks